US009339847B2

(12) United States Patent
Lautala et al.

(10) Patent No.: US 9,339,847 B2
(45) Date of Patent: May 17, 2016

(54) VIBRATING AGGREGATE, AN APPARATUS FOR PROCESSING MINERAL MATERIAL, AND A METHOD FOR MOVING A PROCESSING DEVICE OF AN APPARATUS FOR PROCESSING MINERAL MATERIAL

(75) Inventors: Aki Lautala, Tampere (FI); Antti Harju, Tampere (FI)

(73) Assignee: METSO MINERALS INC., Helsinki (FI)

( * ) Notice: Subject to any disclaimer, the term of this patent is extended or adjusted under 35 U.S.C. 154(b) by 252 days.

(21) Appl. No.: 12/996,528

(22) PCT Filed: Jun. 30, 2008

(86) PCT No.: PCT/FI2008/050398

§ 371 (c)(1),
(2), (4) Date: Dec. 6, 2010

(87) PCT Pub. No.: WO2010/000911

PCT Pub. Date: Jan. 7, 2010

(65) Prior Publication Data

US 2011/0072917 A1 Mar. 31, 2011

(51) Int. Cl.

| | |
|---|---|
| ***B07B 1/42*** | (2006.01) |
| ***B07B 1/28*** | (2006.01) |
| ***B06B 1/10*** | (2006.01) |

(52) U.S. Cl.

CPC . *B07B 1/284* (2013.01); *B06B 1/10* (2013.01); *B07B 1/286* (2013.01); *B07B 1/42* (2013.01); *Y10T 74/18064* (2015.01)

(58) Field of Classification Search

CPC ..... B06B 1/12; B06B 1/163; B06B 1/164

USPC ..... 74/26, 86, 87; 209/365.4, 366.5, 367, 209/369, 381, 386, 920

See application file for complete search history.

(56) References Cited

U.S. PATENT DOCUMENTS

| | | | | |
|---|---|---|---|---|
| 756,950 | A * | 4/1904 | Fraser | 209/366.5 |
| 1,654,815 | A * | 1/1928 | Jubien | B07B 1/30 209/365.2 |

(Continued)

FOREIGN PATENT DOCUMENTS

| | | |
|---|---|---|
| CH | 251734 | 11/1947 |
| CN | 2172161 Y | 7/1994 |

(Continued)

OTHER PUBLICATIONS

Jul. 30, 2012 Office Action issued in Chinese Patent Application 200880130105.1.

(Continued)

*Primary Examiner* — William Kelleher
*Assistant Examiner* — Emily Cheng
(74) *Attorney, Agent, or Firm* — Oliff PLC

(57) ABSTRACT

A vibrating aggregate for moving the processing device, the vibrating aggregate including at least a frame, a shaft having an axial line and being arranged to rotate with respect to the frame, as well as a first element connected to the shaft in such a way that the center of mass of the element is not on the axial line, and fitted to move along a circular path. The vibrating aggregate also comprises a second element coupled to the shaft and arranged to move along a linear path. Furthermore, the invention relates to an apparatus for processing mineral material, and a method for moving the processing device of an apparatus for processing mineral material.

14 Claims, 6 Drawing Sheets

(56) References Cited

U.S. PATENT DOCUMENTS

| | | | | | |
|---|---|---|---|---|---|
| 1,836,757 | A | * | 12/1931 | Kaci | B06B 1/10 74/63 |
| 2,008,296 | A | * | 7/1935 | Soldan | F16C 3/28 209/366 |
| 2,334,973 | A | * | 11/1943 | Whiteman | E01C 19/281 404/117 |
| 2,367,070 | A | | 1/1945 | Symons | |
| 2,561,344 | A | * | 7/1951 | Cutler | A43D 79/00 74/570.2 |
| 2,622,444 | A | * | 12/1952 | Waldvogel | B06B 1/10 74/26 |
| 2,901,111 | A | * | 8/1959 | Eppenberger | 209/344 |
| 3,026,781 | A | * | 3/1962 | Schafer | E01C 19/282 404/117 |
| 3,039,609 | A | * | 6/1962 | Lippmann | 209/341 |
| 3,610,118 | A | * | 10/1971 | Engelhard | 404/117 |
| 3,768,647 | A | * | 10/1973 | Johnson | 209/364 |
| 3,892,496 | A | * | 7/1975 | Lebrero Martinez | 404/117 |
| 4,237,000 | A | * | 12/1980 | Read et al. | 209/319 |
| 4,287,779 | A | | 9/1981 | Goncharov et al. | |
| 4,617,832 | A | * | 10/1986 | Musschoot | 74/87 |
| 6,725,736 | B1 | * | 4/2004 | Sturesson | 74/87 |

FOREIGN PATENT DOCUMENTS

| | | | |
|---|---|---|---|
| CN | 2384692 | Y | 6/2000 |
| CN | 2465821 | Y | 12/2001 |
| CN | 201015764 | Y | 2/2008 |
| DE | 732 979 | | 3/1943 |
| DE | 732979 | | 3/1943 |
| WO | WO 02/00359 | A1 | 1/2002 |

OTHER PUBLICATIONS

Written Opinion of the International Searching Authority in International Application No. PCT/FI2008/050398; dated Mar. 17, 2009.
International Preliminary Report on Patentability in International Application No. PCT/FI2008/050398; dated Oct. 11, 2010.
International Search Report in International Application No. PCT/FI2008/050398; dated Mar. 17, 2009.

* cited by examiner

VIBRATING AGGREGATE, AN APPARATUS FOR PROCESSING MINERAL MATERIAL, AND A METHOD FOR MOVING A PROCESSING DEVICE OF AN APPARATUS FOR PROCESSING MINERAL MATERIAL

FIELD OF THE INVENTION

The invention relates to the processing of mineral material, such as screens and feeders, and particularly aggregates used for moving vibrating screens and feeders.

BACKGROUND OF THE INVENTION

Vibrating screens are used, for example, in crushing plants for sorting material into different classes according to the particle size. A screen comprises a screening element, which may be, for example, a sieve, a mesh or a grate, whose openings are passed by pieces of the material to be screened which are smaller than a given fraction size. The screen may comprise several screening elements, which may be placed, for example, on top of each other. Advantageously, all the screening elements of the screen are moved by joint aggregates. E.g. the publication WO 02/00359 describes such a prior art vibrating aggregate being suitable for moving a screening element of a vibrating screen. Typically, the vibrating screen moves along an elliptical path. In solutions of prior art, the elliptical movement and the direction of the vibrating screen are produced by spring suspension and by rotating two or more eccentric masses in different phases.

There is also so called "directional-action mechanical vibrator" that can be used for moving a screening element. In this kind of solution there is two or more moving masses but these are usually used for balancing each other and the vibration is formed mechanically i.e. not by means of the inertia forces caused by movement of the masses. This type of vibrator is described in publication U.S. Pat. No. 4,287,779.

Feeders as well as vibrating screens are used in crushing plants for the purpose of sorting the material, and feeders are also used for feeding the material to be crushed into the crusher. In the feeder, the smaller fraction that should not to be fed into the crusher, is separated out. With respect to its function, the feeder resembles the vibrating screen.

In solutions of prior art wherein the elliptical movement path is generated by means of the inertia forces, two or more drive shafts are needed for rotating eccentrically rotating masses. The shafts must be synchronized by means of a gearing or cogged belts, which makes the structure complex.

BRIEF SUMMARY OF THE INVENTION

The aim of the arrangement according to the invention is to provide a solution for forming the elliptical path of the mineral material processing apparatus, such as, for example, a screen or a feeder, in a way which is simpler than in prior art.

To achieve this aim, the vibrating aggregate according to the invention is primarily characterized in what will be presented in the independent claim 1. The processing apparatus according to the invention, in turn, is primarily characterized in what will be presented in the independent claim 7. The method according to the invention is, in turn, primarily characterized in what will be presented in the independent claim 12. The other, dependent claims will present some preferred embodiments of the invention.

The basic idea of the invention is that the elliptical movement of the mineral material processing device, such as, for example, a screen or a feeder, is generated by a single rotatable shaft.

According to the basic idea, the apparatus for processing mineral material comprises at least a processing device and a vibrating aggregate for moving the processing device, the vibrating aggregate comprising at least a frame, a shaft having an axial line and being arranged to rotate with respect to the frame, as well as a first element connected to the shaft in such a way that the centre of mass of the element is not on the axial line, and fitted to move along a circular path. Furthermore, the vibrating aggregate comprises a second element coupled to the shaft and arranged to move along a linear path. Preferably, the vibrating aggregate is arranged to move the processing device along an elliptical path.

In the method according to the basic idea, the processing device of the apparatus for processing mineral material is moved along an elliptical path, in which method a part of the movement of the processing device is generated by a first element connected to the rotatable shaft, the centre of mass of the first element being not on the axial line of the shaft, and the first element moving along a circular path when the shaft is moving. Furthermore, a part of the movement of the processing device is generated by a second element connected to the same rotatable shaft, which second element moves along a linear path when the shaft is moving.

In an advantageous embodiment, the path of the second element is perpendicular to the axial line. In one embodiment, the second element is coupled to the shaft in an eccentric way.

In one embodiment, the first element is divided into two parts, which parts are placed in parallel with the axial line on different sides of the second element.

Various advantages are achieved with the different embodiments of the invention. First of all, the elliptical movement of the processing device is generated by a single shaft. Moreover, the ellipticity and direction of the ellipse can be easily adjusted in some embodiments. In one embodiment, the movable masses and bearings are placed close to each other and symmetrically with respect to the side wall of the processing device.

DESCRIPTION OF THE DRAWINGS

In the following, the invention will be described in more detail with reference to the appended principle drawings, in which.

For the sake of clarity, the drawings only show the details necessary for understanding the invention. The structures and details that are not necessary for understanding the invention but are obvious for anyone skilled in the art have been omitted from the figures in order to emphasize the characteristics of the invention. Furthermore, the dimensions of the figures do not necessarily correspond to the reality, but the aim of the figures is to illustrate the principle of the arrangement by selecting the dimensions in a way that is appropriate for the representation.

DETAILED DESCRIPTION OF THE INVENTION

Figure 1:
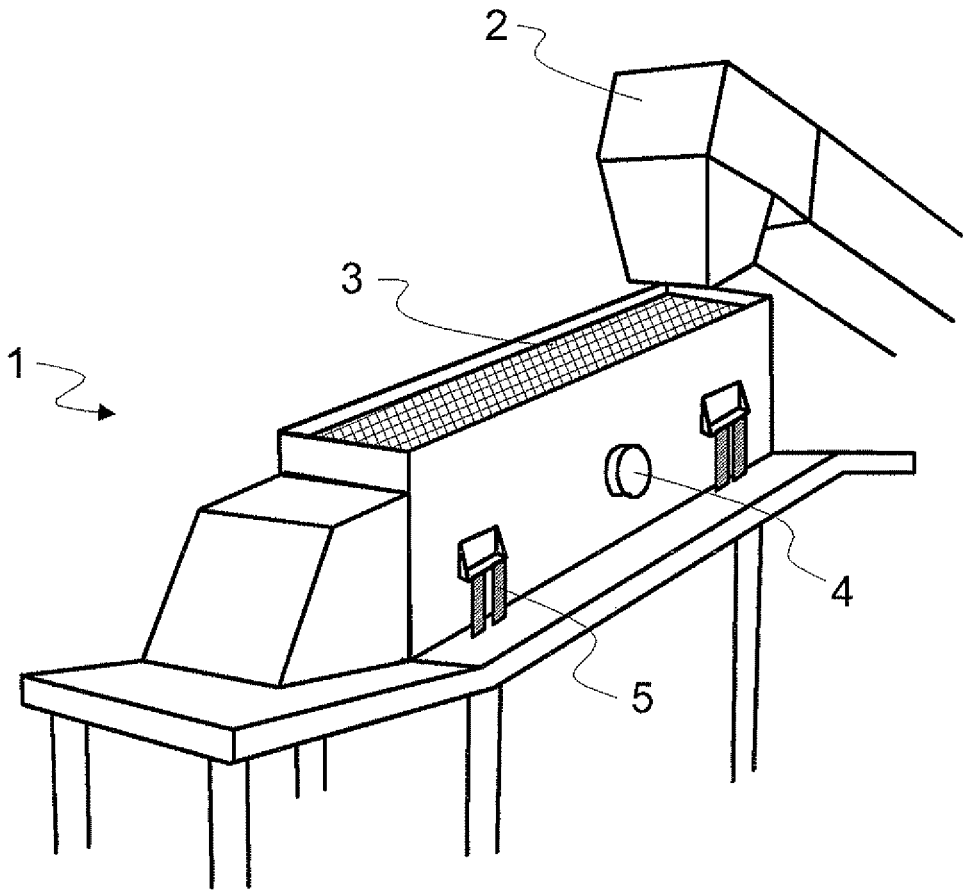
FIG. 1 illustrates the principle of the assembly of the screen device.

FIG. 1 shows a vibrating screen 1 and partly a conveyor 2, by which the material to be screened can be fed onto the screen. The vibrating screen 1 comprises at least a screening element 3 and an aggregate 4 for moving the screening element. The screening element 3 is arranged in the frame, which is fitted with springs 5 in the supporting structures. The aggregate 4 that moves the screening element 3 can be implemented in a variety of ways, and some advantageous embodiments will be presented as follows.

Figure 2:
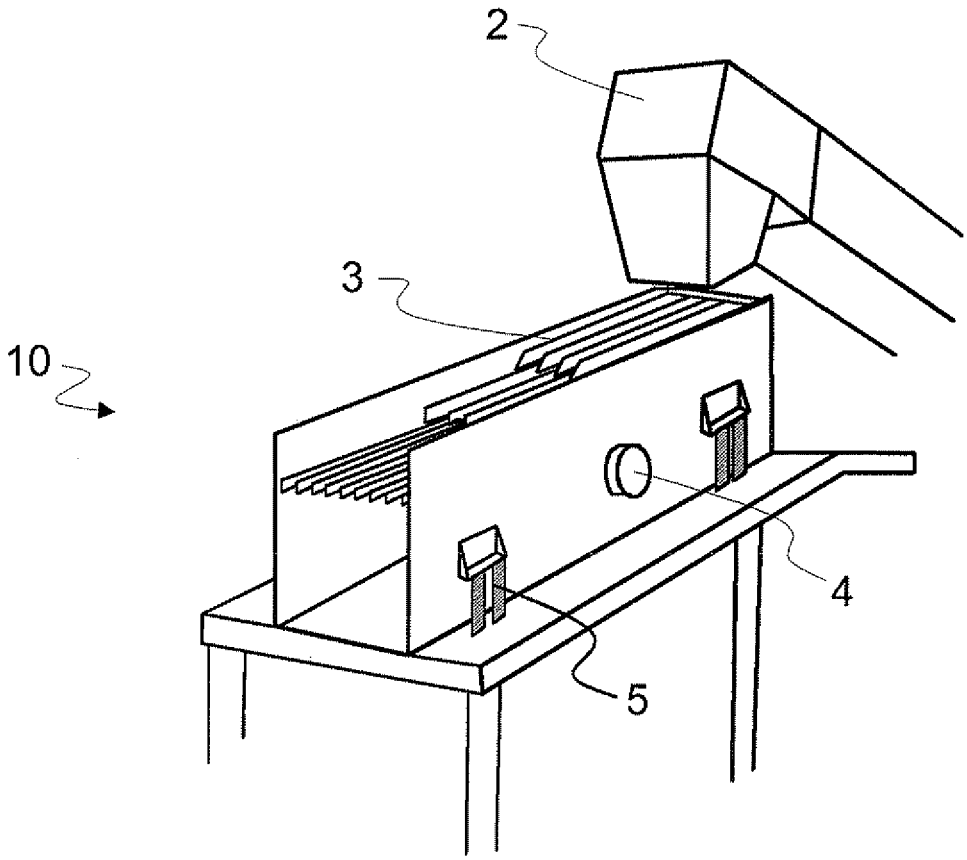
FIG. 2 illustrates the principle of the assembly of the feeder device.

FIG. 2 shows a feeder 10 for feeding the material into the crusher. The feeder comprises at least a screening element 3 and an aggregate 4 for moving the screening element. The screening element 3 is fitted with springs 5 in the supporting structures of the feeder 10.

Figure 3:
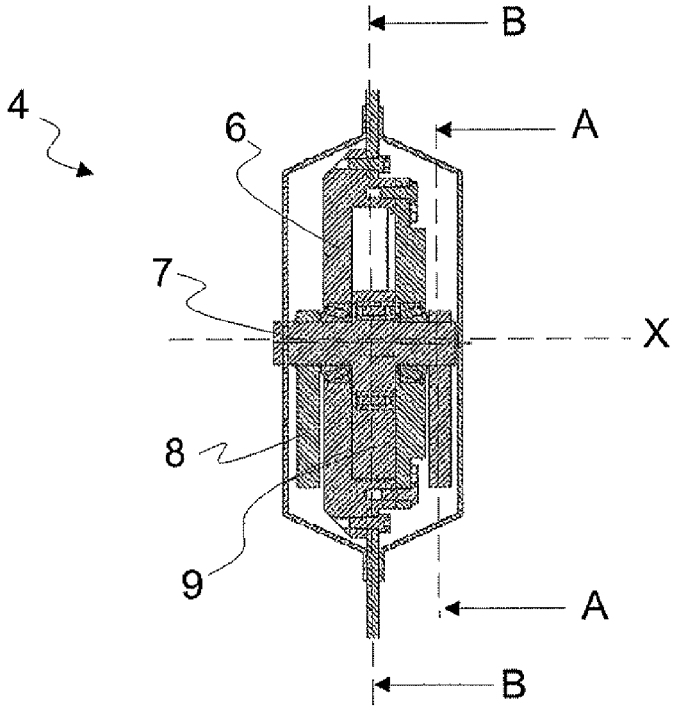
FIG. 3 shows a cross-sectional view of one embodiment of the aggregate along the axial line.
Figure 4:
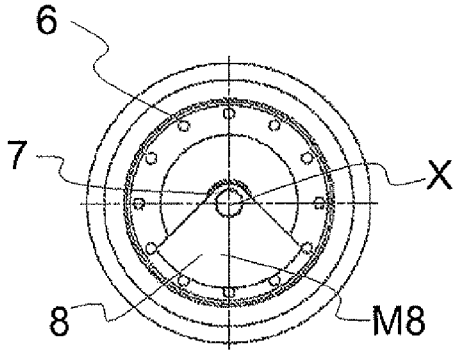
FIG. 4 shows a cross-section of the embodiment according to FIG. 3 in plane A-A.
Figure 5:
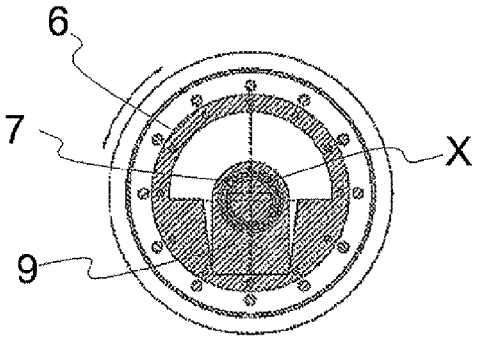
FIG. 5 shows a cross-section of the embodiment according to FIG. 3 in plane B-B.

The aggregate 4 according to FIGS. 3 to 5 comprises at least an aggregate frame 6, a shaft 7 having an axial line X and being arranged to rotate with respect to the aggregate frame, as well as a first element 8, that is, the first movable mass. The first element 8 is connected to the shaft 7 in such a way that the mass centre M8 of the element is not on the axial line X, and the element is arranged to move along a circular path. The aggregate 4 also comprises a second element 9, that is, the second movable mass, coupled to the shaft 7. The second element 9 is arranged to move back and forth along a linear path. The path of the second element 9 is substantially perpendicular to the axial line X. In this embodiment, the second element 9 is placed substantially inside the path of the first element 8.

Figure 6:
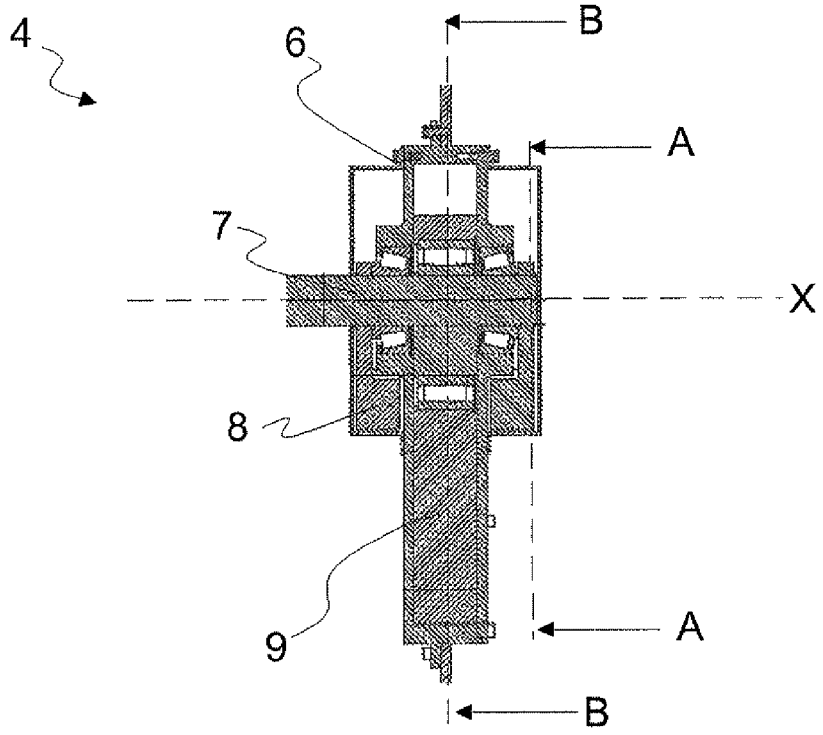
FIG. 6 shows a cross-sectional view of one embodiment of the aggregate along the axial line.
Figure 7:
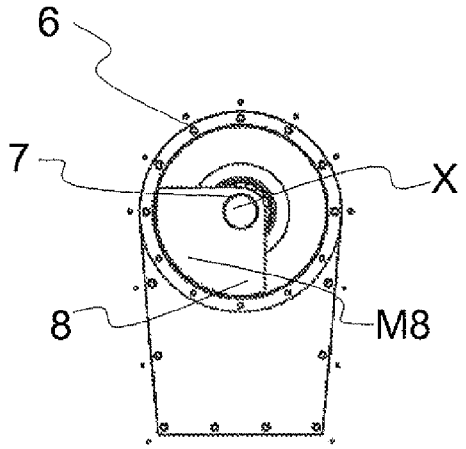
FIG. 7 shows a cross-section of the embodiment according to FIG. 6 in plane A-A.
Figure 8:
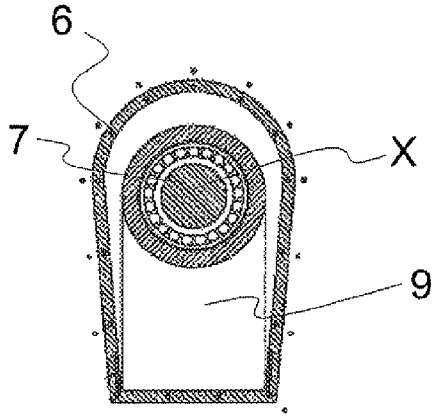
FIG. 8 shows a cross-section of the embodiment according to FIG. 6 in plane B-B.

FIGS. 6 to 8 also show another embodiment. The most essential difference to the previous embodiment is the different implementation of the mass moving linearly back and forth. The second movable element 9 is placed substantially outside the path of the first element 8. This kind of an arrangement is advantageous, for example, when a large mass moving back and forth is needed for generating the desired movement.

In an embodiment in which a large second mass moving back and forth is needed, the second element 9 is formed in such a way that it also extends to the other side of the shaft 7 (for example above and below the shaft).

In the examples shown in FIGS. 3 and 6, the central line of the aggregate 4 is on the central line of the wall of the processing device in such a way that the parts of the first element 8 divided in two parts rotate on both sides of the central line, at an equal distance from the side wall of the processing device. Between these parts of the eccentric masses rotating on both sides, the second element 9 moves on the central line of the side wall of the processing device, the movement being effected by an eccentricity lathed in the driving shaft 7, on which the mass moving back and forth is mounted on bearings. In the preceding examples, the first element 8 is divided into two parts. It is also possible to implement the aggregate 4 in another way. For example, the second element 9 can be formed of two or more parts. Also, the first element 8 may be formed of one, two or more parts. In one embodiment, the first element 8 consists of a single part and the parts of the second element 9 are placed on both sides of the same.

The eccentrically rotating mass, that is, the first element 8, is used to generate a circular movement of the sprung processing device, such as the screen 1 or the feeder 10. Normally, an advantageous movement of the processing device is substantially elliptical. In the presented solutions, the substantially elliptical movement is generated by coupling the eccentrically rotating mass 8 in the same phase as the mass moving back and forth, that is, the second element 9. The shape and the direction of the ellipse are preferably alterable.

The shape of the ellipse can be altered by changing the ratio between the second element 9 and the first element 8, that is, between the mass moving back and forth and the rotating mass. The shape can also be influenced, inter alia, by changing the masses and/or the locations of the mass centres of the first element 8 and the second element 9. Furthermore, the shape of the ellipse can be changed by varying the travelling distance of the second element 9, that is, by varying the eccentricity of the bearing of the second element 9. The direction of the ellipse can be changed by turning the aggregate 4 in a desired direction with respect to the frame of the screen 1. The direction of rotation of the movement, in turn, can be influenced by the direction of rotation of the shaft 7.

Figure 9:
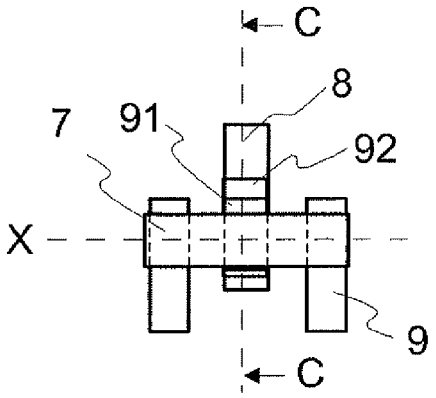
FIG. 9 shows a solution for adjusting the eccentricity of the aggregate.
Figure 10:
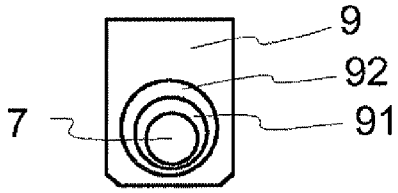
FIG. 10 shows a cross-section of the embodiment according to FIG. 9 in plane C-C.

FIGS. 9 and 10 show a solution for changing the eccentricity of the second element 9. The second element 9 is coupled to the shaft 7 by means of eccentric sleeves 91, 92. The first eccentric sleeve 91 is fitted to rotate in the hole of the second eccentric sleeve 92 when the shaft 7 is rotated. As can be seen from FIG. 10, the hole of the first eccentric sleeve 91, that is, the hole of the shaft 7, is placed eccentrically. Thus, when the shaft 7 rotates, the first eccentric sleeve 91 generates a movement that comprises linear directions of movement. The hole in the second eccentric sleeve 92 is also placed eccentrically. Thus, by turning the second eccentric sleeve 92 in the hole of the second element 9, it is possible to change the location of the hole of the shaft 7 with respect to the frame of the second element. There may also be more than two eccentric sleeves. Alternatively, the eccentric sleeve 91 can be replaced with an eccentricity formed in the shaft, as presented above in the embodiment of FIG. 3.

The arrangement of adjustment shown in FIGS. 9 and 10 can also be used to change the eccentricity of the first element 8, if necessary. If the element 8, 9 to be adjusted is divided into two or more parts, each part can be equipped with separate eccentric sleeves 91, 92.

Figure 11:
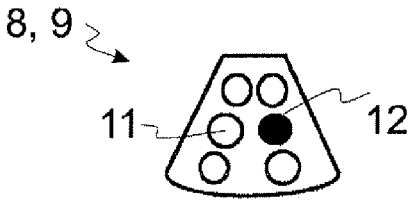
FIG. 11 shows an arrangement for adjusting the movable mass of the aggregate.
Figure 12:
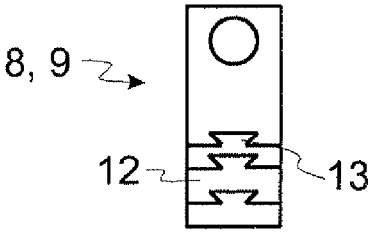
FIG. 12 shows another arrangement for adjusting the movable mass of the aggregate.

FIGS. 11 and 12 show some solutions for adjusting the mass of the element 8, 9. In the arrangement of FIG. 11, the element 8, 9 is provided with locations 11 for adjustable masses 12. FIG. 12, in turn, presents another way of providing the element 8, 9 with adjustable masses. In this solution, the element 8, 9 is provided with a connecting area 13 to which the adjustable masses 12 can be connected. Advantageously, the adjustable masses 12 also comprise a corresponding connecting area 13, in which case it is possible to couple several adjustable masses, if necessary. Adjustable masses 12 can be preferably added or removed as needed. The adjustable masses 12 can be used to influence the total mass and/or the mass centre of the element 8, 9 and thereby the movement generated by the aggregate 4.

Figure 13:
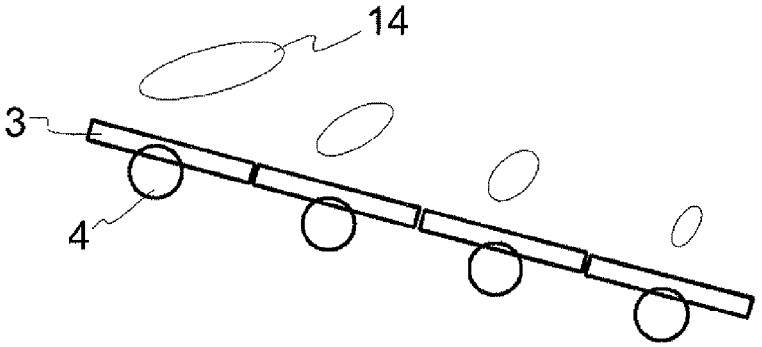
FIG. 13 illustrates the principle of a multi-step feeder apparatus.

FIG. 13 shows the principle of operation of a multi-step apparatus. The apparatus may be, for example, a screen and/ or a feeder that comprises several individual screening and/or feeding elements. In the example, the feeder device comprises four screening elements 3. Each screening element 3 is equipped with a separate aggregate 4 for moving the screening element. The figure shows, in principle, the direction and magnitude of the path of each screening element 4 by ellipses 14. The ellipses 14 represent the paths by way of example, and they illustrate primarily the relationships between the paths of the different screening elements 3. The paths are affected in the above-presented ways, for example, by changing the masses and/or the mass centres of the first element 8 and the second element 9 in the aggregate 4. Furthermore, the shape of the path 14 can be changed by varying the travelling distance of the second element 9, that is, by varying the eccentricity of the bearing of the second element 9. The direction of the ellipse 14 can be changed by turning the aggregate 4 with respect to the frame of the screen 1. In the example, the first screening element 3 (on the left-hand side) is arranged to perform the greatest movement. Thus, the material to be fed moves strongly, and the desired fractions can be effectively removed from it. The following screening elements perform a smaller movement in such a way that the path of the screening element on the right-hand side is the shortest. The paths of the different screening elements may also be different from those shown in the example, for the path of each screening element can be advantageously adjusted independently. The independent adjustment makes it possible to save power and to use the feeder device, the screening device or another processing device in an optimal way.

The basic principle of the novel arrangement relating to the processing of mineral material was presented above. Some details, such as, for example, the bearings, the lubrication, the compensation of wearing, the adjustment of the masses, the mountings, etc., can be implemented in ways not shown in the examples.

In the examples, the first element 8 was formed in such a way that the geometrical centre of the mass and the mass centre M8 are by the side of the axial line X. It is also possible to form the first element 8 in such a way that its geometrical centre is on the axial line X even if the mass centre M8 were not on the axial line. For example, the first element 8 can be formed of a ring in which one sector has a greater mass than the rest of the ring.

The shaft 7 can be rotated by a suitable actuator, such as, for example, an electrical motor or a hydraulic motor (not shown in the figures). The actuator may be coupled to the shaft 7 either directly or by means of suitable intermediate structures, such as gearings, clutches and/or belts. Preferably, the actuator is coupled to the shaft 7 in such a way that the power is transmitted from the actuator to the shaft via an elastic clutch.

In one embodiment, on both sides of the processing device, there are aggregates 4 coupled to each other by the shaft and elastic clutches.

Figure 14:
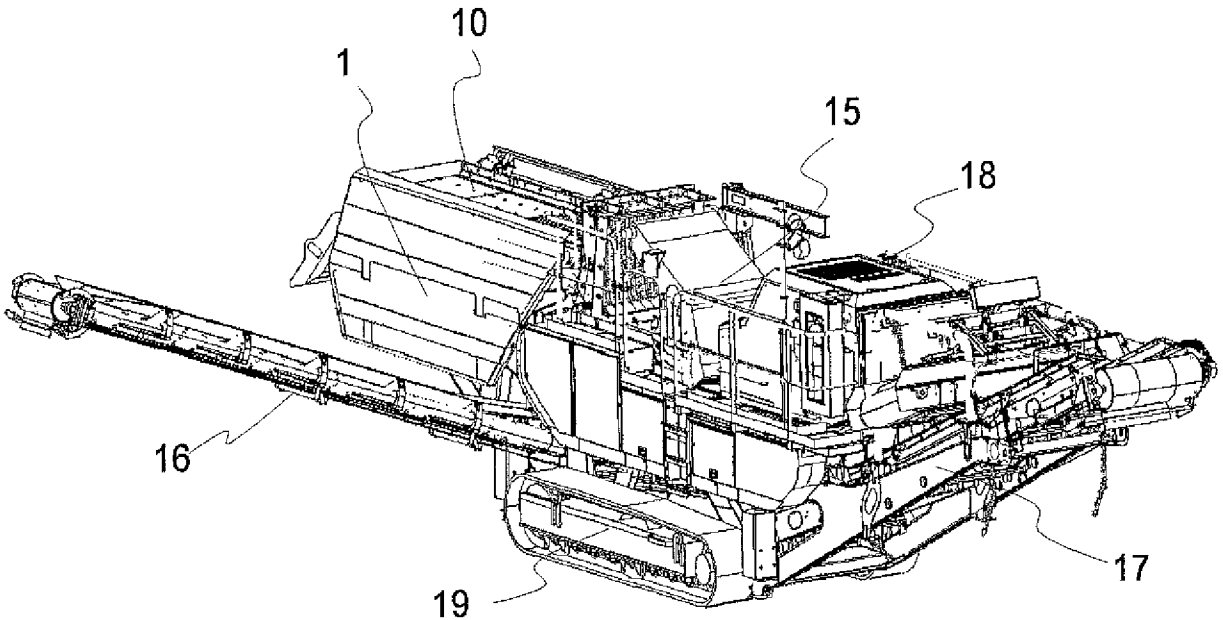
FIG. 14 shows an apparatus for processing mineral material.

FIG. 14 shows a crushing plant which is suitable for the processing of mineral material, such as for the crushing of rock or the recirculation of construction material, such as for the processing of reinforced concrete. The crushing plant comprises a feeder 10 for feeding material to be crushed further to a screen 1, and to a crusher 15, such as a cone, gyratory, jaw, or centrifugal crusher. The crushing plant further comprises a side conveyor 16 and a main conveyor 17 as well as a power source 18 for driving the actuators, and a caterpillar drive 19 for moving the crushing plant.

In the example, the crushing plant is a movable plant with a crusher mounted on a caterpillar drive. The crushing plant can also be moved by other means, such as wheels or legs, or it may be stationary.

By combining, in various ways, the modes and structures disclosed in connection with the different embodiments of the invention presented above, it is possible to produce various embodiments of the invention in accordance with the claims. Therefore, the above-presented examples must not be interpreted to restrict the invention, but the embodiments of the invention may be freely varied within the scope of the inventive features presented in the claims hereinbelow.

The invention claimed is:

1. A vibratory aggregate for an apparatus for processing mineral material, the vibratory aggregate comprising:

a frame;

a shaft having an axis extending in a first direction, the shaft being arranged to rotate with respect to the frame, and the shaft having an eccentric portion;

a first element coupled to the shaft outside of the frame such that a mass centre of the first element is not on the axis of the shaft, the first element being arranged to rotate with the shaft, rotation of the shaft and the first element causing the shaft and the first element to move along a circular path; and a second element inside of the frame having (i) a first end coupled to the eccentric portion of the shaft and (ii) a free second end, the eccentric portion being disposed within the first end of the second element, the eccentric portion being rotatable relative to the first end of the second element, and the free second end of the second element being (a) configured to move along a substantially linear path in a first direction when the shaft is rotating at a constant speed, and (b) restricted by the frame from movement in a second direction, perpendicular to the first direction, and in a direction of the axis of the shaft, wherein a phase of the movement of the first element in relation to a phase of the movement of the free second end of the second element is adjusted such that an elliptical movement of the vibratory aggregate is generated when the shaft is rotated, the second element is one uniform piece, and when viewed from the first direction, the path of the second element is at least partly within the path of the first element.

2. The aggregate according to claim 1, wherein the substantially linear path of the free second end of the second element is perpendicular to the axis of the shaft.

3. The aggregate according to claim 1, wherein the first element is divided into two parts, which parts are oriented in parallel with each other and displaced in a direction of the axis of the shaft on different sides of the second element.

4. The aggregate according to claim 1, wherein the eccentric portion of the shaft is embedded within the first end of the second element.

5. A processing apparatus for processing mineral material, comprising at least a processing device and a vibrating aggregate for moving the processing device, the vibrating aggregate comprising:

a frame;

a shaft having an axis extending in a first direction, the shaft being arranged to rotate with respect to the frame, and the shaft having an eccentric portion;

a first element coupled to the shaft outside of the frame such that a mass centre of the first element is not on the axis of the shaft, the first element being arranged to rotate with the shaft, rotation of the shaft and the first element causing the shaft and the first element to move along a circular path; and a second element inside of the frame having (i) a first end coupled to the eccentric portion of the shaft and (ii) a free second end, the eccentric portion being disposed within the first end of the second element, the eccentric portion being rotatable relative to the first end of the second element, and the free second end of the second element being (a) configured to move along a substantially linear path in a first direction when the shaft is rotating at a constant speed, and (b) restricted by the frame from movement in a second direction, perpendicular to the first direction, and in a direction of the axis of the shaft, wherein a phase of the movement of the first element in relation to a phase of the movement of the free second end of the second element is adjusted such that an elliptical movement of the vibratory aggregate is generated when the shaft is rotated, the second element is one uniform piece, and when viewed from the first direction, the path of the second element is at least partly within the path of the first element.

6. The processing apparatus according to claim 5, wherein the aggregate is arranged to move the processing device along an elliptical path.

7. The processing apparatus according to claim 6, wherein the substantially linear path of the free second end of the second element is perpendicular to the axis of the shaft.

8. The processing apparatus according to claim 6, wherein the processing apparatus is one of the following: a feeder, a screen, a stationary crushing plant and a movable crushing plant.

9. The processing apparatus according to claim 5, wherein the eccentric portion of the shaft is embedded within the first end of the second element.

10. A method for moving a processing device of a mineral material processing apparatus along an elliptical path, the method comprising:

generating a first portion of the movement of the processing device by a first element rotatably connected to a rotatable shaft, which is arranged to rotate with respect to a frame, and moving along a circular path with the shaft when the shaft is rotating about an axis of the shaft, the first element being coupled to the shaft outside of the frame and positioned such that a centre of mass of the first element is not on the axis of the shaft; and generating a second portion of the movement of the processing device by a second element having a first end connected to an eccentric portion of the rotatable shaft inside of the frame, the rotatable shaft being disposed within the first end of the second element, and a free second end of the second element being (a) configured to move along a substantially linear path in a first direction when the shaft is rotating at a constant speed, and (b) restricted by the frame from movement in a second direction, perpendicular to the first direction, by a frame and in a direction of the axis of the shaft, wherein a phase of the movement of the first element in relation to a phase of the movement of the free second end of the second element is adjusted such that an elliptical movement of the vibratory aggregate is generated when the shaft is rotated, the second element is one uniform piece, and when viewed from the first direction, the path of the second element is at least partly within the path of the first element.

11. The method according to claim 10, wherein the free second end of the second element moves in a direction perpendicular to the axis of the shaft.

12. The method according to claim 10, wherein a shape of the elliptical path is adjusted by changing a relationship between the mass of the rotating first element and a mass of the second element.

13. The method according to claim 10, wherein a shape of the elliptical path is adjusted by changing a travel distance of the free second end of the second element moving substantially linearly.

14. The method according to claim 10, wherein the eccentric portion of the rotatable shaft is embedded within the first end of the second element.

* * * * *